US010669798B2

(12) United States Patent
Al-Qasim et al.

(10) Patent No.: US 10,669,798 B2
(45) Date of Patent: Jun. 2, 2020

(54) METHOD TO MITIGATE A STUCK PIPE DURING DRILLING OPERATIONS

(71) Applicant: Saudi Arabian Oil Company, Dhahran (SA)

(72) Inventors: Abdulaziz S. Al-Qasim, Dhahran (SA); Mohammed Al-Arfaj, Dhahran (SA); Sunil Kokal, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 198 days.

(21) Appl. No.: 15/960,716

(22) Filed: Apr. 24, 2018

(65) Prior Publication Data

US 2019/0323311 A1 Oct. 24, 2019

(51) Int. Cl.

| | |
|---|---|
| ***E21B 17/10*** | (2006.01) |
| ***E21B 21/00*** | (2006.01) |
| ***E21B 31/00*** | (2006.01) |
| ***E21B 27/00*** | (2006.01) |

(52) U.S. Cl.
CPC ..... *E21B 31/00* (2013.01); *E21B 17/1078* (2013.01); *E21B 27/00* (2013.01)

(58) Field of Classification Search
CPC ..... E21B 17/1078; E21B 27/00; E21B 31/00; E21B 31/03
See application file for complete search history.

(56) References Cited

U.S. PATENT DOCUMENTS

| | | | | |
|---|---|---|---|---|
| 2,569,893 | A | 10/1951 | Kendall et al. | |
| 2,894,585 | A | 7/1959 | Erwin | |
| 3,762,470 | A | 10/1973 | Eggleston | |
| 4,043,410 | A | 8/1977 | Bennett et al. | |
| 6,349,766 | B1 | 2/2002 | Bussear et al. | |
| 7,546,878 | B2 | 6/2009 | Prado et al. | |
| 8,091,644 | B2 | 1/2012 | Clark et al. | |
| 8,162,054 | B2 | 4/2012 | Schultz et al. | |
| 9,291,018 | B2 | 3/2016 | Korn, Jr. et al. | |
| 9,528,338 | B2 | 12/2016 | Hall | |
| 2004/0084186 | A1 | 5/2004 | Allison | |
| 2005/0022994 | A1 | 2/2005 | Wilson | |
| 2011/0083845 | A1 | 4/2011 | McLaughlin | |
| 2011/0132606 | A1 | 6/2011 | Demong et al. | |
| 2013/0233620 | A1* | 9/2013 | Rankin | E21B 21/103 175/57 |
| 2015/0252630 | A1* | 9/2015 | Moyer | E21B 17/1078 166/301 |

(Continued)

OTHER PUBLICATIONS

International Search Report and Written Opinion for International Application No. PCT/US2019/028719 dated Aug. 22, 2019; pp. 1-13.

*Primary Examiner* — Daniel P Stephenson
(74) *Attorney, Agent, or Firm* — Bracewell LLP; Constance G. Rhebergen; Brian H. Tompkins

(57) ABSTRACT

Provided are systems and methods for freeing differentially stuck pipe via the in-situ release of fluids from fluid-releasing tanks coupled to a centralizer or stabilizer of a pipe. Fluid-releasing tanks may be coupled to a centralizer or stabilizer of a pipe and located around the circumference of the pipe. Nozzles may be connected to the fluid-releasing tanks to enable the in-situ release of fluid from the fluid-releasing tanks. Various mechanisms may be used to open the nozzles and release the fluid from the fluid-releasing tanks.

20 Claims, 4 Drawing Sheets

(56) References Cited

U.S. PATENT DOCUMENTS

| | | | | |
|---|---|---|---|---|
| 2016/0160618 | A1 | 6/2016 | Batarseh et al. | |
| 2017/0130570 | A1 | 5/2017 | Al-Nakhli et al. | |
| 2019/0323311 | A1* | 10/2019 | Al-Qasim | E21B 31/03 |
| 2019/0338601 | A1* | 11/2019 | Smith | E21B 10/56 |

* cited by examiner

METHOD TO MITIGATE A STUCK PIPE DURING DRILLING OPERATIONS

BACKGROUND

Field of the Disclosure

The present disclosure generally relates to drilling and production of hydrocarbons. More specifically, embodiments of the disclosure relate to freeing stuck pipe in a well.

Description of the Related Art

Drilling and production systems are employed to access and extract hydrocarbons from hydrocarbon reservoirs in geologic formations. During the course of drilling a well, pipe (such as a drill string or casing) placed (for example, inserted) into the well may become stuck such that the pipe is unable to be rotated or reciprocated and cannot be removed from the well without damaging the pipe. The main causes of stuck pipe are differential sticking or mechanical sticking. Differential sticking occurs when a pressure differential across a permeable zone of the formation causes a vacuum seal which locks the drill string or casing in place. Differential sticking of pipe may be caused by excessive overbalance pressure in a permeable zone as a result of poor hole cleaning, poor quality filter cakes, or an accumulation of cuttings. Differential sticking may also be caused by leaving a drill string stationary in a permeable zone.

Stuck pipe may result in a stoppage of drilling operations and may account for up to half of the total well costs. Stuck pipe may be associated with well control and lost circulation problems that can also increase the costs and risks of drilling. Stuck pipe may cause significant increases in costs due to the loss of drill strings, casing, or even the complete loss of the well. In some instances, stuck pipe may result in damage to the pipe, parts of the bottom hole assembly (BHA), or other expensive components.

SUMMARY

Embodiments of the disclosure generally relate to apparatus and methods for freeing stuck pipe in a well via fluid-releasing tanks that release of a fluid downhole to dissolve a filter cake or accumulated cuttings and help free the stuck pipe. As described in the disclosure, the fluid-releasing tanks may be attached to the centralizers or stabilizers of a drill pipe and may contain a fluid releasable through nozzles of the tank via a release mechanism.

In one embodiment, a system for freeing differentially stuck pipe in a wellbore is provided. The system includes a differentially stuck pipe in a wellbore and a plurality of components disposed along the length of the pipe. Each of the plurality of components is a centralizer or a stabilizer. The system further includes a fluid-releasing tank coupled to one of the plurality of components and containing a fluid. The system also includes a nozzle connected to the tank and configured to release the fluid into the wellbore such that the fluid interacts with the material contacting the pipe. In some embodiments, the fluid includes hydrochloric acid. In some embodiments, the pipe includes a drill pipe. In some embodiments, the fluid-releasing tank is permanently coupled to the at least one of the plurality of components. In some embodiments, the fluid-releasing tank is formed from heterodiamond. In some embodiments, the nozzle is a heat-sensitive nozzle configured to change from a closed position to an open position when the temperature of the nozzle is greater than a threshold temperature, such that the open position enables the release of fluid from the tank into the wellbore. In some embodiments, the material is a filter cake. In some embodiments, the fluid-releasing tank is first fluid releasing tank, such that the system includes a second fluid-releasing tank coupled to the one of the plurality of components, the second fluid-releasing tank containing the fluid. In some embodiments, the first fluid releasing tank is located 180° around the circumference of the pipe with respect to the second fluid releasing tank. In some embodiments, the fluid interacts with the material contacting the pipe by reducing a friction between the pipe and the material. In some embodiments, the fluid interacts with the material contacting the pipe by reducing a differential pressure between a formation fluid and a drilling fluid.

In another embodiment, a method for freeing differentially stuck pipe is provided. The method includes initiating the release of a fluid from a fluid-releasing tank coupled to one of the plurality of components disposed along the length of the differentially stuck pipe, such that the fluid is released through a nozzle into the wellbore and interacts with a material contacting the pipe. Each of the plurality of components is a centralizer or a stabilizer. Additionally, the method includes freeing the differentially stuck pipe after the fluid interacts with the material contacting the pipe. In some embodiments, the fluid is hydrochloric acid. In some embodiments, the method includes allowing the fluid to interact with the material surrounding the portion of differentially stuck pipe over a time period. In some embodiments, the material is a filter cake. In some embodiments, the nozzle is a heat-sensitive nozzle configured to change from a closed position to an open position when the temperature of the nozzle is greater than a threshold temperature. In some embodiments, initiating the release of the fluid from the fluid-releasing tank includes generating heat to increase the temperature of the nozzle greater than the threshold temperature such that the nozzle changes from the closed position to the open position to enable the release of the fluid. In some embodiments, generating heat to increase the temperature of the nozzle greater than the threshold temperature includes moving the differently stuck pipe to generating heat from friction between the differentially stuck pipe and the material. In some embodiments, the fluid-releasing tank is permanently coupled to one of the plurality of components.

In another embodiment, an apparatus for freeing differentially stuck pipe in a wellbore is provided. The apparatus includes a fluid-releasing tank configured to be coupled to a centralizer or a stabilizer of a drill pipe, the tank having an interior volume configured to contain a fluid. The apparatus also includes a nozzle configured to be connected to the tank and to release the fluid from the tank. In some embodiments, the apparatus includes the fluid, and the fluid includes hydrochloric acid. In some embodiments, the nozzle is a heat-sensitive nozzle configured to change from a closed position to an open position when the temperature of the nozzle is greater than a threshold temperature.

DETAILED DESCRIPTION

The present disclosure will be described more fully with reference to the accompanying drawings, which illustrate embodiments of the disclosure. This disclosure may, however, be embodied in many different forms and should not be construed as limited to the illustrated embodiments. Rather, these embodiments are provided so that this disclosure will be thorough and complete, and will fully convey the scope of the disclosure to those skilled in the art.

Embodiments of the disclosure include apparatuses and methods for freeing stuck pipe, such as drill pipe, in a wellbore. In some embodiments, fluid-releasing tanks are coupled to one or more centralizers or stabilizers of a pipe located downhole in a wellbore of a well. The fluid-releasing tanks contain a fluid suitable for freeing stuck pipe. For example, in some embodiments, the fluid may be hydrochloric acid. The tank may include a plurality of nozzles directed radially outward from the pipe. When a stuck pipe occurs, the fluid may be released in-situ from the tank via the nozzles.

Advantageously, the in-situ release of the fluid from the fluid-releasing tanks may dissolve the filter cake and accumulated solid material (for example, cuttings) that cause the stuck pipe. The in-situ release of the fluids from fluid-releasing tanks already present on the pipe may reduce the time, cost, and risk associated with prior art procedures for freeing differentially stuck pipe (for example, via pumping a spotting fluid from the surface into the wellbore). Additionally, the fluids released from the fluid-releasing tanks may act as a zonal reducer of the drilling fluid weight and reduce the differential pressure between the drilling fluid and the reservoir.

Figure 1:
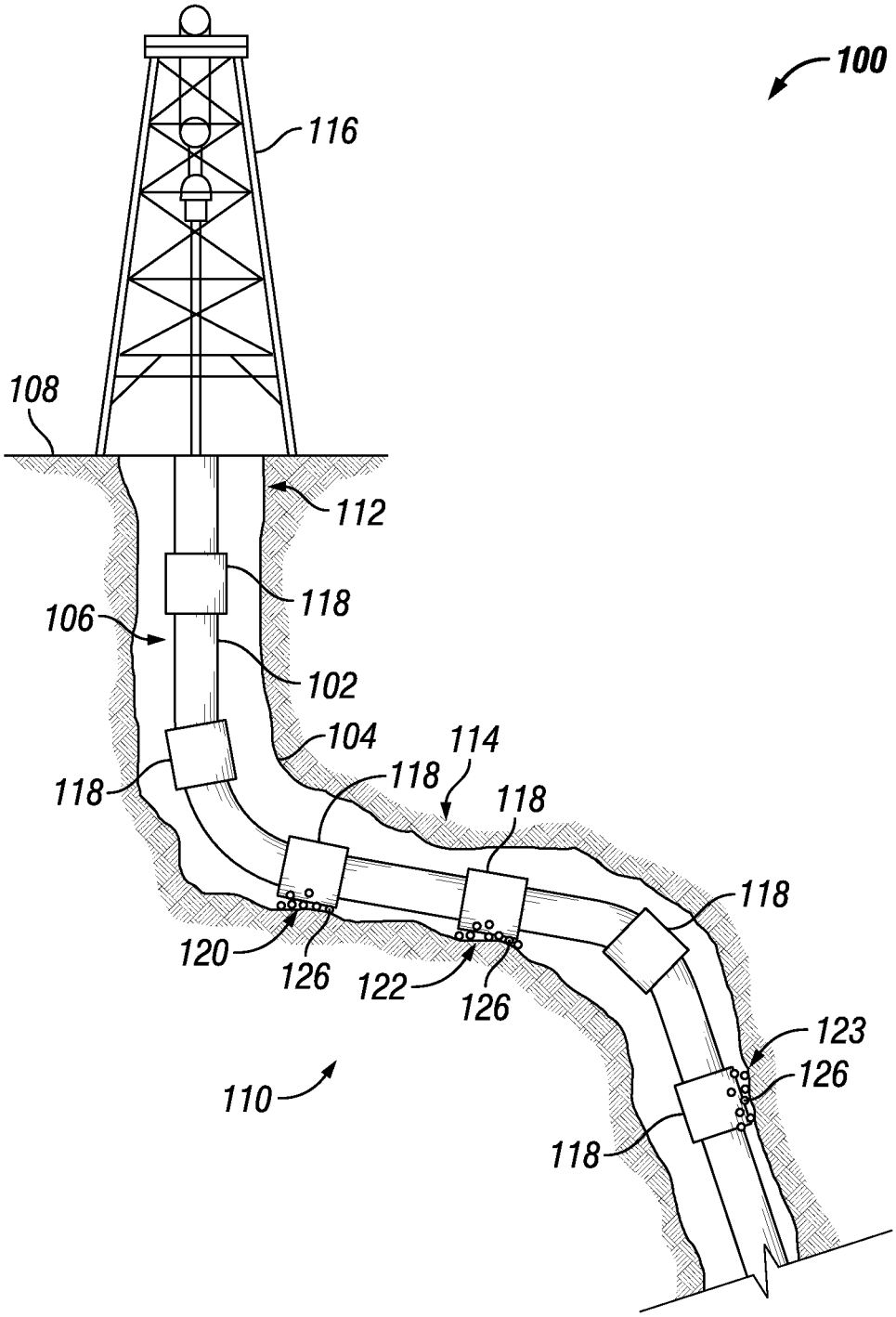
FIG. 1 is schematic diagram of a wellsite having a pipe in a subsurface well with multiple fluid-releasing tanks in accordance with an embodiment of the disclosure.

FIG. 1 is a schematic diagram of a wellsite 100 having a pipe 102 in a subsurface well 104 with multiple fluid-releasing tanks in accordance with an embodiment of the disclosure. The well 104 defines a wellbore 106 that form a fluid pathway extending from the surface 108 into a hydrocarbon bearing formation 110. In some embodiments, the wellbore 106 may have various sections, including vertical sections 112 and a slanted section 114. As will be appreciated, in other embodiments, a wellbore may include multiple vertical sections, slanted sections, horizontal sections, and transition sections between different sections.

The pipe 102 may represent a drill pipe (which may be refer to or be described as a portion of a "drill string") run into the wellbore 106 via drilling rig 116. As will be appreciated, the drill pipe may be coupled to a bottom hole assembly (BHA) and a drill bit (not shown) for drilling the well 104 according to operations known in the art. As the wellbore is further defined, additional pipe may be placed (that is, "run") in the wellbore 106 to extend the length of the pipe 102 during drilling and facilitate access to a reservoir of the hydrocarbon-bearing formation. During such operations, sticking of the pipe 102 may cause cessation of drilling operations and may damage the pipe 102 or other components such as the BHA.

As shown in FIG. 1, the pipe 102 may include multiple components 118 disposed along the length of the pipe 102. The components 118 shown in FIG. 1 may represent centralizers or stabilizers coupled to or formed in the pipe 102. As known in the art, centralizers may be located at various positions along the outer diameter of the pipe 102 and may centralize the pipe 102 within the wellbore 106 (for example, to ensure that the pipe 102 is in radially centered with respect to the wellbore 106). In some embodiments, the centralizers may be expanded via a hydraulic mechanism, mechanical mechanism, or both. As known in the art, stabilizers may be located at various positions along the outer diameter of the pipe 102 and may mechanically stabilize the pipe 102 (or components coupled to the pipe, such as a bottom hole assembly (BHA)) to minimize or eliminate vibrations, sidetracking, or other perturbations.

During operation, the pipe 102 may become stuck in the wellbore 104. For example, locations 120, 122, and 123 depict locations in the wellbore 104 for which portions of the pipe 102 have become stuck. As discussed in the disclosure, fluid-releasing tanks coupled to the components 118 may release fluids (depicted by dots 126) to facilitate release of the stuck pipe 102 and restore free movement in the wellbore 104. The fluid may be released from fluid-releasing tanks coupled to the component 118 (for example, centralizer or stabilizer) that is nearest the portions of the pipe 102 that are stuck.

As will be appreciated, the pulling force ($F_{pulling}$) required to free differentially stuck pipe is related to the differential pressure ($\Delta P$) exerted by the formation (that is between the formation fluid pressure and the drilling fluid pressure), the contact area (A) and a friction factor (f) caused by the contact between the pipe and the surfaces of a filter cake. The pulling force may be expressed according to Equation 1:

$$F_{pulling}=\Delta P\times A\times f \tag{1}$$

Consequently, the in-situ introduction of a fluid via the fluid-releasing tanks described in the disclosure may significantly reduce the friction factor caused by contact between the pipe and the filter cake and other solid particles that cause the sticking, thus reducing the pulling force. The reduced pulling force may be expressed by Equation 2:

$$F_{reduced\text{-}pulling}=\Delta P\times A\times f_m \tag{2}$$

Where $f_m$ is a modified friction factor resulting from the in-situ release of the fluid from the fluid-releasing tanks. By reducing the pulling force via the in-situ release of the fluids from the fluid-releasing tanks, the differentially stuck pipe may be freed and drilling operations may continue.

Figure 2:
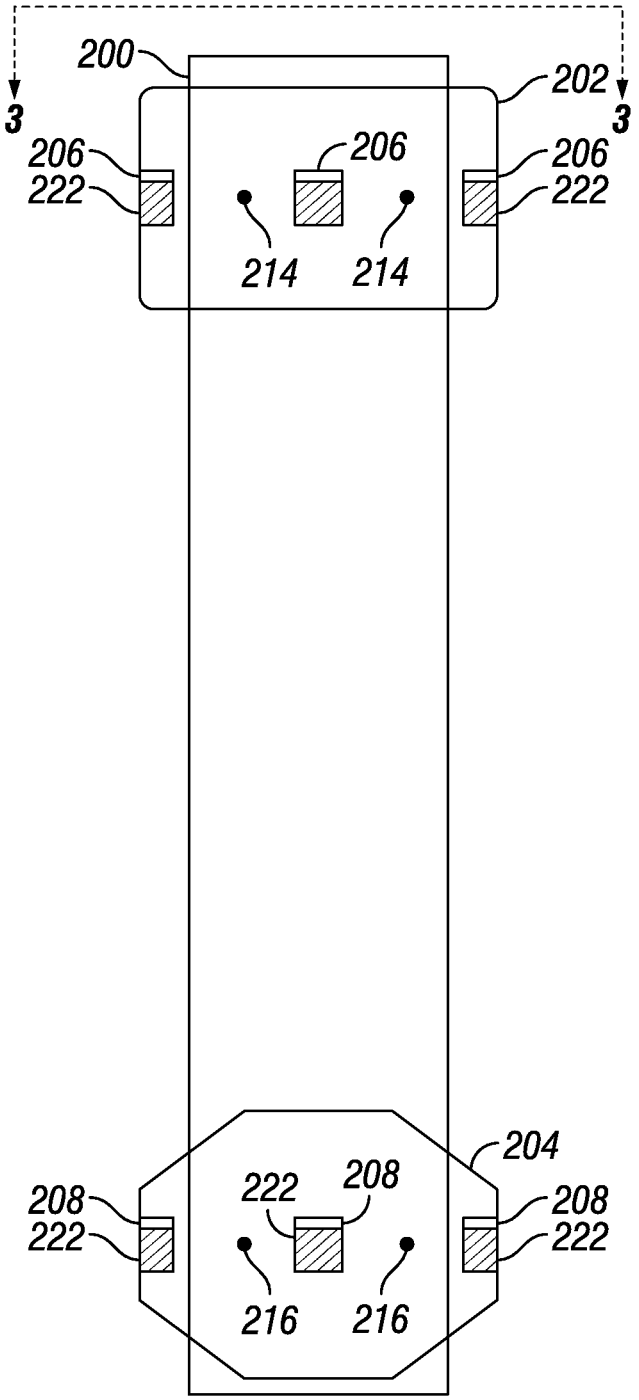
FIG. 2 is a schematic diagram of a section of pipe having a centralizer and a stabilizer and fluid-releasing tanks respectively coupled to the centralizer and stabilizer in accordance with an embodiment of the disclosure.

FIG. 2 is a schematic diagram of a pipe section 200 having, for example, a centralizer 202 and a stabilizer 204 and fluid-releasing tanks 206 and 208 respectively coupled to the centralizer 202 and the stabilizer 204 in accordance with an embodiment of the disclosure. The pipe section 200 may represent, for example, a section of drill pipe. As will be appreciated, although FIG. 2 is described with reference to the centralizer 202 and the stabilizer 204, other embodiments of the disclosure may have fluid-releasing tanks only coupled to centralizers on a pipe or only coupled to stabilizers on a pipe.

The fluid-releasing tanks 206 and 208 may be located at different locations around the circumference of the pipe 200. For example, the fluid-releasing tanks 206 may be located around the circumference of a pipe at 90° or 180° from each other. Similarly, the fluid-releasing tanks 208 may be located around the circumference of a pipe at 90° or 180° from each other. In some embodiments, the centralizer 202 and the stabilizer 204 may have the same number of tanks. In other embodiments, the number of tanks coupled to each stabilizer or centralizer may be different.

Figure 3:
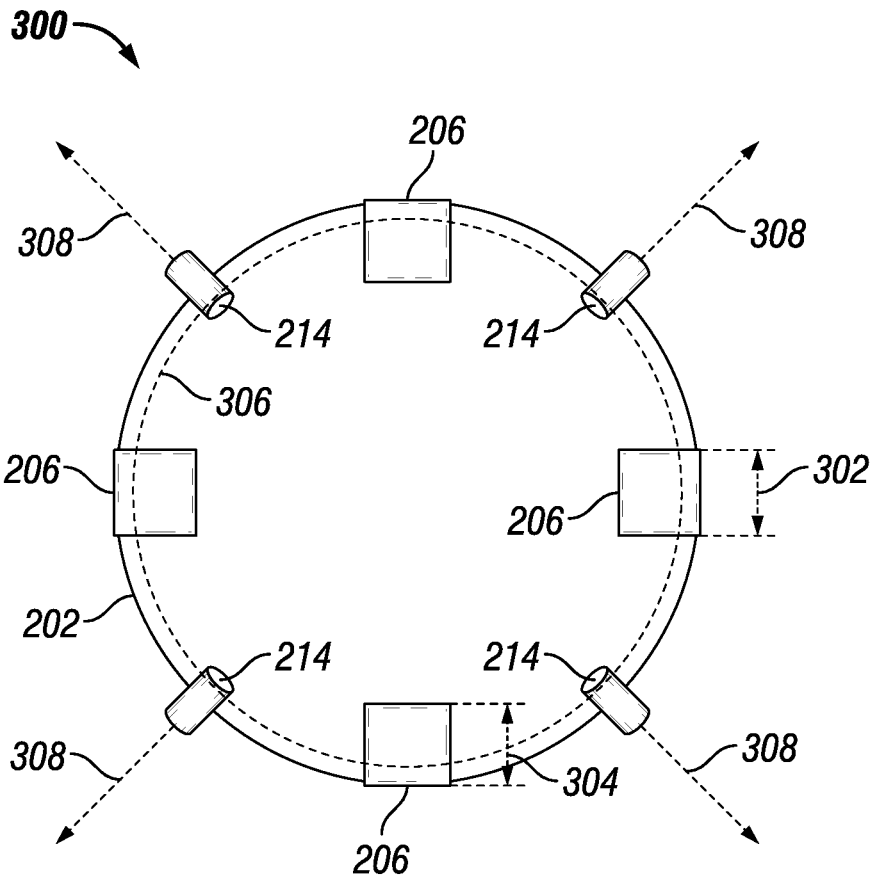
FIG. 3 is a top view of a section of pipe taken along line 3-3 of FIG. 2 in accordance with an embodiment of the disclosure.

In some embodiments, 3 or 4 fluid-releasing tanks 206 may be coupled to the centralizer 202. As shown in FIGS. 2 and 3, for example, 4 fluid-releasing tanks 206 may be coupled to the centralizer 202. In other embodiments, 5, 6, 7, or 8 fluid-releasing tanks may be coupled to a centralizer. Thus, the number of fluid releasing tanks coupled to a centralizer may be in the range of 3 to 8. In some embodiments, 3 or 4 fluid-releasing tanks 208 may be coupled to the stabilizer 204. In the embodiment shown in FIG. 2, for example, 4 fluid-releasing tanks 208 may be coupled to the stabilizer 204. In other embodiments, 5, 6, 7, or 8 fluid-releasing tanks may be coupled to a stabilizer. Accordingly, the number of fluid releasing tanks coupled to a stabilizer may be in the range of 3 to 8.

As shown in FIG. 2, the fluid-releasing tanks 206 may be in fluid connection with nozzles 214 and the fluid-releasing tanks 208 may be in fluid connection with nozzles 216. The nozzles 214 may be coupled to the centralize 202 and the nozzles 216 may be coupled to the stabilizer 204. The fluid-releasing tanks 206 and 208 may contain a fluid 222 suitable for releasing stuck pipe. In some embodiments, the number of nozzles 214 coupled to the centralizer 202 may be in the range of about 6 to about 12. In some embodiments, the number of nozzles 216 coupled to the stabilizer 204 may be in the range of about 6 to about 12.

As described in the disclosure, the nozzles 214 and 216 may provide the release of the fluid 222 from the fluid-releasing tanks 206 and 208 respectively via a mechanism that opens the nozzles 214 and 216 and releases the fluid through the nozzles 214 and 216. For example, the fluid 222 may be released in-situ from the fluid-releasing tanks 206 through the nozzles 214 and into the wellbore to contact material at least partially surrounding a portion of the stuck pipe at the centralizer 202 and aid in releasing the pipe when the pipe become differentially stuck during an operation on a well. In another example, the fluid 222 may be released in-situ from the fluid-releasing tanks 208 through the nozzles 216 and into the wellbore to contact material at least partially surrounding a portion of the stuck pipe at the stabilizer 204.

In some embodiments, the fluid 222 may be hydrochloric acid. In other embodiments, the fluid 222 may include other fluids, such as other acids, combinations of acids, or spotting fluid compositions specifically formulated for the release of stuck pipe. Such spotting fluids may include, for example, proprietary commercial spotting fluids. In some embodiments, each tank disposed along a pipe may contain the same fluid. In other embodiments, one or more of the fluid-releasing tanks disposed along a pipe may contain different fluids. For example, in some embodiments, the fluid 222 in each of tanks 206 or 208 may be the same fluid or, in other embodiments, each of the fluid-releasing tanks 206 or 208 may contain different fluids. In some embodiments, a top portion of each of the fluid-releasing tanks 206 and 208 may be removable to enable filling the fluid-releasing tanks 206 and 208 with fluid. In other embodiments, the each of the fluid-releasing tanks 206 and 208 may have a cap or other component designed to enable filling of the fluid.

The fluid-releasing tanks 206 and 208 may be included on a pipe at different frequency (that is, tank position per length of pipe. In some embodiments, fluid-releasing tanks may be located at every one meter (m) of pipe that is anticipated to pass through doglegs or relatively steep sections of a well.

In some embodiments, each tank 206 and 208 may be generally rectangular shaped. In other embodiments, each tank 206 and 208 may be square-shaped, cylindrical-shaped, or may have other shapes. As will be appreciated, the dimensions (for example, width, depth, and length) of each tank 206 and 208 may be selected depending on the size of the centralizer 202 or the stabilizer 204 for which the tank is to be coupled to or integrated with. For example, in some embodiments, the depth of each tank 206 and 208 may be one inch. In certain embodiments, the fluid-releasing tanks 206 and 208 may be sized to provide a minimum clearance between the fluid-releasing tanks 206 and 208 and the inside diameter of a wellbore (sometimes referred to as the "borehole"). In some embodiments, the fluid-releasing tanks 206 and 208 may be formed from heterodiamond.

The fluid-releasing tanks 206 and nozzles 214 may be removably or permanently coupled to the centralizer 202. For example, in some embodiments, the fluid-releasing tanks 206, nozzles 214, or both may be welded or otherwise permanently coupled to the centralizer 202. In some embodiments, for example, the fluid-releasing tanks 206, nozzles 214, or both may be coupled to the centralizer 202 via fasteners (for example, screws). In some embodiments, the fluid-releasing tanks 206, nozzles 214, or both may be integrated into a centralizer 202, such that the fluid-releasing tanks 206, nozzle 214, or both form part of the structure of the centralizer 202. Similarly, the fluid-releasing tanks 208 and nozzles 216 may be removably or permanently coupled to the stabilizer 204. For example, in some embodiments, the fluid-releasing tanks 208, nozzles 216, or both may be welded or otherwise permanently coupled to the stabilizer 204. In some embodiments, for example, the fluid-releasing tanks 208, nozzles 216, or both may be coupled to the stabilizer 204 via fasteners (for example, screws). In some embodiments, the fluid-releasing tanks 206, nozzles 214, or both may be integrated into a stabilizer 204, such that the fluid-releasing tanks 206, nozzle 214, or both form part of the structure of the stabilizer 204.

Embodiments of the disclosure may include various mechanisms for releasing the fluids 214 and 216 from the fluid-releasing tanks 206 and 208 and out of the nozzles 214 and 216. Such mechanisms may include, by way of example, heat-sensitive nozzles, electronic telemetric control mechanisms, or hydraulic mechanisms.

In some embodiments, the release mechanism may include a heat-based release mechanism. In such embodiments, the nozzles 214 and 216 may be heat-sensitive nozzles that open responsive to exposure to heat greater than a certain temperature. In such embodiments, various mechanisms may be used for generating the heat to open the nozzles 214 and 216. For example, in some embodiments, the heat locally generated by the friction of attempting to move differentially stuck pipe in a wellbore may be sufficient to open the nozzles 214 or 216 and release the fluid contained inside the fluid-releasing tanks 206 and 208. In other embodiments, the heat may be generated by microwaves or electrical power, either directly applied to the fluid-releasing tanks or nozzles or to in the vicinity of the nozzles (such as in the wellbore). In such embodiments, the nozzles may remain open and may not have the capability of re-closing. In other embodiments, the nozzles 214 and 216 may close after the temperature of the nozzles cools to less than a temperature threshold (for example, as the temperature decreases to ambient wellbore temperature).

In some embodiments, the release mechanism may be electronic such that the nozzles 214 and 216 may be opened using telemetric control from the surface. In such embodiments, the nozzles may be responsive to electromagnetic waves of at a certain amplitude and frequency. For example, an electromagnetic signal may be sent from a control module located at the surface to the nozzles 214 and 216 via an electrical cable that provides for the transmission of electrical signals from the surface to the nozzles 214 and 216. The nozzles 214 and 216 may be electrically actuated such that the electrical signal may open the nozzles 214 and 216 and release the fluid from the fluid-releasing tanks into the wellbore. In some embodiments, the fluid in the fluid-releasing tanks may be pressurized such the pressurized fluid exits the nozzles 214 and 216 when the nozzles 214 and 216 are opened.

FIG. 3 is a top view 300 of the pipe 200 taken along line 3-3 in accordance with an embodiment of the disclosure. As shown in FIG. 3, each tank 206 may have a width 302 and a depth 304. FIG. 3 further illustrates the location of the fluid-releasing tanks 206 around the circumference of the pipe section 200. For example, in the embodiment shown in FIG. 3, each tank is located 90° from circumferentially adjacent tanks around the circumference of the pipe section 200. Similarly, each nozzle 214 is located circumferentially between each tank 206 and located 90° from circumferentially adjacent nozzles around the circumference of the pipe section 200. It should be appreciated that FIG. 3 depicts one example embodiment and other embodiments may include tanks and nozzles at different locations.

The nozzles 214 may be connected to the fluid-releasing tanks 206 to enable the flow of fluids from the fluid-releasing tanks 206 and through the nozzles 214. For example, in some embodiments the nozzles 214 and tanks 206 may be connected by a tube 306 that may be span the circumference of the pipe section 200. The tube 306 may be formed from metal, plastic, or other suitable materials and may enable the flow of fluids from the fluid-releasing tanks 206 to the nozzles and, as shown by arrows 308, out of the nozzles 214 and into the wellbore surrounding the pipe section 200.

Figure 4:
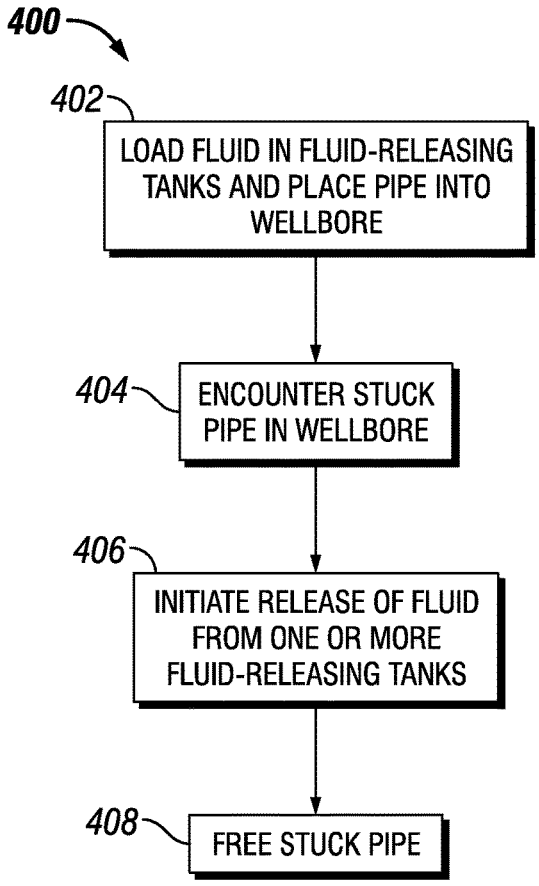
FIG. 4 is a block diagram of a process for freeing differentially stuck pipe using fluid-releasing tanks in accordance with an embodiment of the disclosure.

FIG. 4 depicts a process 400 for freeing differentially stuck pipe in accordance with an embodiment of the disclosure. In some embodiments, a fluid may be loaded in fluid-releasing tanks coupled to a stabilizer or centralizer of a pipe (for example, drill pipe) to be placed into a wellbore (block 402). After insertion into a wellbore, differentially stuck pipe may be encountered (block 404). The in-situ release of fluid in the fluid-releasing tanks located on one or more stabilizers or centralizers may be initiated (block 406). In some embodiments, for example, the location in the wellbore at which a portion of the pipe has encountered a cause of differential sticking (for example, the location at which a portion of the pipe is sticking to filter cake) may be determined. In such embodiments, the release of fluid may be initiated from a tank coupled to the centralizer or stabilizer nearest to the portion of pipe encountering the differential sticking. After releasing the fluid from the fluid-releasing tanks, the stuck pipe may then be freed after the fluid contacts a filter cake or other material at least partially surrounding a portion of the differentially stuck pipe (block 408). In some embodiments, the released fluid may be allowed to interact with the material (for example, filter cake) for a time period. After the time period, the pipe may then be moved and freed. In some embodiments, if the fluid released from the fluid-releasing tanks is acidic, a basic solution (for example, a sodium hydroxide solution) may be pumped into the wellbore to neutralize the fluid.

Figure 5:
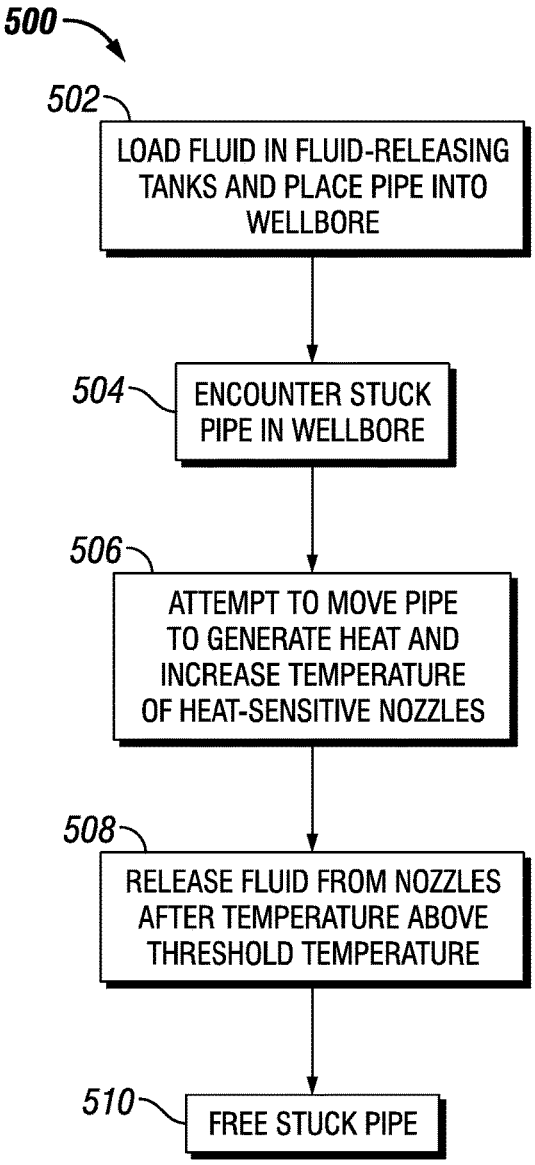
FIG. 5 is a block diagram of a process for freeing differentially stuck pipe using fluid-releasing tanks in accordance with another embodiment of the disclosure.

As discussed supra, in some embodiments, the fluid-releasing tanks may be fluidly connected to heat-sensitive nozzles that open after heating greater than a specific temperature. FIG. 5 depicts a process 500 for freeing differentially stuck pipe using fluid-releasing tanks fluidly connected to heat-sensitive nozzles in accordance with an embodiment of the disclosure. In some embodiments, a fluid may be placed in fluid-releasing tanks coupled to a stabilizer or centralizer of a pipe (for example, drill pipe) to be placed into a wellbore (block 502). After insertion into a wellbore, differentially stuck pipe may be encountered (block 504).

In embodiments having heat-sensitive nozzles, the differentially stuck pipe may be shifted to generate heat and increase the temperature of the heat sensitive nozzles coupled to the fluid-releasing tanks (block 506). For example, the differently stuck pipe may be reciprocated or rotated in different directions as far as allowed by the differential sticking (for example, although the pipe may not be moveable enough to facility continuing of a drilling operation, the pipe may have sufficient movement to enable enough friction to generate heat). After a sufficient amount of heat is generated, the temperature of the heat-sensitive nozzles may be increased to greater than a threshold temperature such that the nozzles open and release fluid in-situ into the wellbore (block 508). In some embodiments, the threshold temperature is a temperature greater than the wellbore temperature and, in some embodiments, greater than the temperature of fluids in the fluid-releasing tanks. After releasing the fluid from the fluid-releasing tanks, the stuck pipe may then be freed after the fluid contacts a filter cake or other material at least partially surrounding a portion of the differentially stuck pipe (block 510). In some embodiments, the released fluid may be allowed to interact with the material (for example, filter cake) for a time period. After the time period, the pipe may then be moved and freed. In some embodiments, if the fluid released from the fluid-releasing tanks is acidic, a basic solution (for example, a sodium hydroxide solution) may be pumped into the wellbore to neutralize the fluid.

Ranges may be expressed in the disclosure as from about one particular value, to about another particular value, or both. When such a range is expressed, it is to be understood that another embodiment is from the one particular value, to the other particular value, or both, along with all combinations within said range.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments described in the disclosure. It is to be understood that the forms shown and described in the disclosure are to be taken as examples of embodiments. Elements and materials may be substituted for those illustrated and described in the disclosure, parts and processes may be reversed or omitted, and certain features may be utilized independently, all as would be apparent to one skilled in the art after having the benefit of this description. Changes may be made in the elements described in the disclosure without departing from the spirit and scope of the disclosure as described in the following claims. Headings used described in the disclosure are for organizational purposes only and are not meant to be used to limit the scope of the description.

What is claimed is:

1. A system for freeing differentially stuck pipe in a wellbore, comprising:

a differentially stuck pipe in a wellbore;

a plurality of components disposed along the length of the pipe, wherein each of the plurality of components is a centralizer or a stabilizer;

a fluid-releasing tank coupled to one of the plurality of components, the fluid-releasing tank containing a fluid; and a nozzle connected to the tank and configured to release the fluid into the wellbore such that the fluid interacts with the material contacting the pipe, wherein the nozzle comprises a heat-sensitive nozzle configured to change from a closed position to an open position when the temperature of the nozzle is greater than a threshold temperature, wherein the open position enables the release of fluid from the tank into the wellbore.

2. The system of claim 1, wherein the fluid comprises hydrochloric acid.

3. The system of claim 1, wherein the pipe comprises a drill pipe.

4. The system of claim 1, wherein the fluid-releasing tank is permanently coupled to the at least one of the plurality of components.

5. The system of claim 1, wherein the fluid-releasing tank is formed from heterodiamond.

6. The system of claim 1, wherein the material comprises a filter cake.

7. The system of claim 1, wherein the fluid-releasing tank is first fluid releasing tank, the system comprising a second fluid-releasing tank coupled to the one of the plurality of components, the second fluid-releasing tank comprising the fluid.

8. The system of claim 7, wherein the first fluid releasing tank is located 180° around the circumference of the pipe with respect to the second fluid releasing tank.

9. The system of claim 1, wherein the fluid interacts with the material contacting the pipe by reducing a friction between the pipe and the material.

10. The system of claim 1, wherein the fluid interacts with the material contacting the pipe by reducing a differential pressure between a formation fluid and a drilling fluid.

11. A method of freeing differentially stuck pipe in a wellbore, comprising:

initiating the release of a fluid from a fluid-releasing tank coupled to one of a plurality of components disposed along the length of the differentially stuck pipe, the differentially stuck pipe resulting from a pressure differential across a permeable zone of a formation, wherein each of the plurality of components is a centralizer or a stabilizer, such that the fluid is released through a nozzle into the wellbore and interacts with a material contacting the pipe; and freeing the differentially stuck pipe after the fluid interacts with the material contacting the pipe.

12. The method of claim 11, wherein the fluid comprises hydrochloric acid.

13. The method of claim 11, comprising allowing the fluid to interact with the material surrounding the portion of differentially stuck pipe over a time period.

14. The method of claim 11, wherein the material comprises a filter cake.

15. The method of claim 11, wherein the nozzle comprises a heat-sensitive nozzle configured to change from a closed position to an open position when the temperature of the nozzle is greater than a threshold temperature.

16. The method of claim 15 wherein initiating the release of the fluid from the fluid-releasing tank comprises generating heat to increase the temperature of the nozzle greater than the threshold temperature such that the nozzle changes from the closed position to the open position to enable the release of the fluid.

17. The method of claim 16, wherein generating heat to increase the temperature of the nozzle greater than the threshold temperature comprises moving the differently stuck pipe to generating heat from friction between the differentially stuck pipe and the material.

18. The method of claim 11, wherein the fluid-releasing tank is permanently coupled to one of the plurality of components.

19. An apparatus for freeing differentially stuck pipe in a wellbore, comprising:

a fluid-releasing tank configured to be coupled to a centralizer or a stabilizer of a drill pipe, the tank comprising an interior volume configured to contain a fluid; and a nozzle configured to be connected to the tank and to release the fluid from the tank, wherein the nozzle comprises a heat-sensitive nozzle configured to change from a closed position to an open position when the temperature of the nozzle is greater than a threshold temperature.

20. The apparatus of claim 19, comprising the fluid, wherein the fluid comprises hydrochloric acid.

* * * * *